US009003564B2

(12) United States Patent
Wynh

(10) Patent No.: US 9,003,564 B2
(45) Date of Patent: Apr. 14, 2015

(54) BABY CLOTHING APPARATUS

(71) Applicant: Jennifer Wynh, Anaheim, CA (US)

(72) Inventor: Jennifer Wynh, Anaheim, CA (US)

( * ) Notice: Subject to any disclaimer, the term of this patent is extended or adjusted under 35 U.S.C. 154(b) by 184 days.

(21) Appl. No.: 13/712,986

(22) Filed: Dec. 13, 2012

(65) Prior Publication Data

US 2014/0165257 A1 Jun. 19, 2014

(51) Int. Cl.

| | |
|---|---|
| ***A41D 11/00*** | (2006.01) |
| ***A41B 13/06*** | (2006.01) |
| *A41D 10/00* | (2006.01) |

(52) U.S. Cl.

CPC ..... *A41B 13/06* (2013.01); *A41B 13/065* (2013.01)

(58) Field of Classification Search

CPC ..... A41B 13/06; A41B 13/065; A41D 11/00; A41D 15/00; A41D 15/02; A41D 15/04; A41D 2400/482; A41D 2400/48

USPC ..... 2/80, 83, 69, 69.5, 105, 106, 113–115, 2/85, 96, 95, 108, 102

See application file for complete search history.

(56) References Cited

U.S. PATENT DOCUMENTS

| | | | | | |
|---|---|---|---|---|---|
| 1,556,747 | A | * | 10/1925 | Bates, Jr. | 128/872 |
| 2,130,771 | A | * | 9/1938 | Mann | 2/69.5 |
| 2,307,266 | A | * | 1/1943 | Hansen | 2/114 |
| 2,441,900 | A | * | 5/1948 | Oswald | 2/69.5 |
| 2,442,192 | A | * | 5/1948 | Bookbinder | 2/69.5 |
| 2,444,652 | A | * | 7/1948 | Gracia | 2/69.5 |
| 2,496,922 | A | * | 2/1950 | Virtue | 2/69.5 |
| 2,535,936 | A | * | 12/1950 | Langley | 128/873 |
| 2,546,057 | A | * | 3/1951 | Bodin et al. | 2/270 |
| 2,562,061 | A | * | 7/1951 | Peterson | 2/69.5 |
| 2,611,131 | A | * | 9/1952 | Heeter | 2/69.5 |
| 2,613,359 | A | * | 10/1952 | Boyce | 2/69.5 |
| 2,651,781 | A | * | 9/1953 | Buchholz | 2/69.5 |
| 2,652,052 | A | * | 9/1953 | Smith | 128/873 |
| 2,657,387 | A | * | 11/1953 | Ketcham | 2/69.5 |
| 2,723,398 | A | * | 11/1955 | Tuteur | 2/69.5 |
| 2,888,009 | A | * | 5/1959 | Taylor | 128/873 |
| 3,093,132 | A | * | 6/1963 | Bailey | 128/873 |
| 4,295,230 | A | * | 10/1981 | Blodgett | 2/69.5 |
| 4,901,371 | A | * | 2/1990 | Christians | 2/69.5 |
| 5,621,917 | A | * | 4/1997 | Howsden | 2/111 |
| 6,076,186 | A | * | 6/2000 | Grose | 2/75 |
| 6,105,168 | A | * | 8/2000 | Hazen | 2/69.5 |
| 6,219,847 | B1 | * | 4/2001 | Aikins | 2/69 |
| 6,266,821 | B1 | * | 7/2001 | Quintana | 2/69.5 |
| 6,266,822 | B1 | * | 7/2001 | Joyce | 2/83 |
| 6,401,248 | B1 | * | 6/2002 | Christensen | 2/69 |
| 6,408,439 | B1 | * | 6/2002 | Garforth-Crippen | 2/80 |
| 6,662,390 | B1 | * | 12/2003 | Berger | 5/486 |
| 2011/0186057 | A1 | * | 8/2011 | Hatton | 128/889 |

* cited by examiner

*Primary Examiner* — Gloria Hale

(74) *Attorney, Agent, or Firm* — John D. Tran; Rhema Law Group, P.C.

(57) ABSTRACT

A clothing apparatus for a baby comprising of a garment containing a plurality of sleeves, a neck aperture, and a closed bottom edge. The garment of the clothing apparatus may be coupled to a Cover by a plurality of securing means and in one preferred embodiment, the Cover is in the form of a blanket which can be positioned over the baby's torso region inside the garment. The clothing apparatus is adjustable and can be configured in a variety of ways to accommodate for changes in temperature.

19 Claims, 12 Drawing Sheets

BABY CLOTHING APPARATUS

INCORPORATION BY REFERENCE

Applicant(s) hereby incorporate herein by reference any and all U.S. patents and U.S. patent applications cited or referred to in this application.

BACKGROUND OF THE INVENTION

1. Field of the Invention

Aspects of this invention relate generally to apparatuses that can be used for clothing a baby, specifically for providing clothing that is adjustable to accommodate for changes in temperature during a single period of sleep. For the purposes of this application, the inventor uses the terms baby, infant and newborn interchangeably. In addition, the inventor uses the terms device and apparatus interchangeably.

2. Description of Related Art

A goal of clothing for babies is to allow the baby to be comfortable at all times but in particular during periods of sleep. It is popular for babies to wear one-piece clothing for convenience and to allow convenience for the caretaker to change the baby's diaper when necessary. Depending on the temperature, it is often desirable to use a blanket to keep the baby warm in colder environments or unzip the one-piece clothing or remove pieces of clothing to keep the baby cool in warmer environments. However, many pediatric experts recommend babies sleeping in a blanket-free environment to reduce the risk of Sudden Infant Death Syndrome (SIDS). Thus, the use of a loose blanket to keep a baby warm is modernly frowned upon and alternative methods of keeping a baby warm is recommended.

In warmer environments, although unzipping a one-piece clothing or removing pieces of clothing may allow the baby to be cooler, it does not solve the situation in which a change in temperature may cause the need to re-clothe the baby which may be inconvenient for the caretaker during a period of sleep for the baby. Adding or removing a piece of clothing to a baby during sleep also runs the risk of waking up the baby thereby interrupting the baby's sleep.

A variety of clothing apparatuses have been developed. For example, U.S. Pat. No. 7,246,392 to Schmid et. al. provides a wearable blanket and a swaddling accessory. The wearable blanket is in the form a Cover which can be used in conjunction of a swaddle accessory.

However, the prior art clothing lacks simple adjustment features and fails to provide a clothing apparatus which incorporates the benefits of clothing in the form of a wearable garment and a removable cover like blanket to accommodate changes in temperature.

SUMMARY OF THE INVENTION

A clothing apparatus to worn by a baby comprising of a garment sized and configured for being worn by a baby that has sleeves. The garment is in the form of a wearable cover which is closed at the bottom but has an opening at top for the baby's head and neck. The clothing apparatus also comprising a cover sized and configured for selectively enclosing at least a portion of the garment whereby the cover is in the form a blanket that can be pulled or slithered up to the baby's torso area to provide additional warmth.

The cover in the form of a blanket can be coupled to the garment of the clothing apparatus by a zipper which allows the user to attach and detach the cover when desired to accommodate for different temperatures. In one embodiment, the garment and cover are coupled by a zipper at the bottom portion of the garment thereby preventing the cover in the form a blanket to raise above the torso of the baby thus preventing the risk that the cover blanket interferes with the baby's breathing and prevents the risk of rebreathing (i.e. the inhalation of carbon dioxide). The cover can be removed from the garment without having to interfere with the baby inside of the garment thereby preventing waking up the baby unnecessarily.

In one embodiment, the garment contains sleeves that are adjustable and cuffs that are adjustable to accommodate for change of temperature and to ensure maximum comfortability for the baby.

In another embodiment, the baby clothing apparatus comprises of a sleeveless configuration.

Both the garment and cover of the clothing apparatus contain zippers on the outside that allow the user a convenient way to access the baby when inside the clothing apparatus in order to check and/or change the baby's diaper.

Aspects of the present invention teach certain benefits in construction and use which give rise to the exemplary advantages described below.

In an exemplary embodiment of the invention, a clothing apparatus to be worn by a baby is provided which comprises of a garment with adjustable sleeves and cuffs and a removable cover that can be in the form of a blanket.

A primary objective inherent in the present invention is to provide clothing apparatus to be worn by a baby that is a wearable blanket that is adjustable to accommodate for changes in temperature.

Another objective inherent in the present invention is to provide a clothing apparatus to be worn by a baby that allows for easy and convenient access to the baby at all times for diaper changes.

Other features and advantages of aspects of the present invention will become apparent from the following more detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings.

Features, elements, and aspects of the invention that are referenced by the same numerals in different figures represent the same, equivalent, or similar features, elements, or aspects, in accordance with one or more embodiments.

DETAILED DESCRIPTION OF THE INVENTION

The invention and its various embodiments can now be better understood by turning to the following detailed description of the preferred embodiments, which are presented as illustrated examples of the invention defined in the claims. It is expressly understood that the invention as defined by the claims may be broader than the illustrated embodiments described below.

Many alterations and modifications may be made by those having ordinary skill in the art without departing from the spirit and scope of the invention. Therefore, it must be understood that the illustrated embodiment has been set forth only for the purposes of example and that it should not be taken as limiting the invention as defined by the following claims. For example, notwithstanding the fact that the elements of a claim are set forth below in a certain combination, it must be expressly understood that the invention includes other combinations of fewer, more or different elements, which are disclosed herein even when not initially claimed in such combinations.

The words used in this specification to describe the invention and its various embodiments are to be understood not only in the sense of their commonly defined meanings, but to include by special definition in this specification structure, material or acts beyond the scope of the commonly defined meanings. Thus if an elements can be understood in the context of this specification as including more than one meaning, then its use in a claim must be understood as being generic to all possible meanings supported by the specification and by the word itself.

The definitions of the words or elements of the following claims therefore include not only the combination of elements which are literally set forth, but all equivalent structure, material or acts for performing substantially the same function in substantially the same way to obtain substantially the same result. In this sense it is therefore contemplated that an equivalent substitution of two or more elements may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a sub-combination or variation of a sub-combination.

Figure 1:
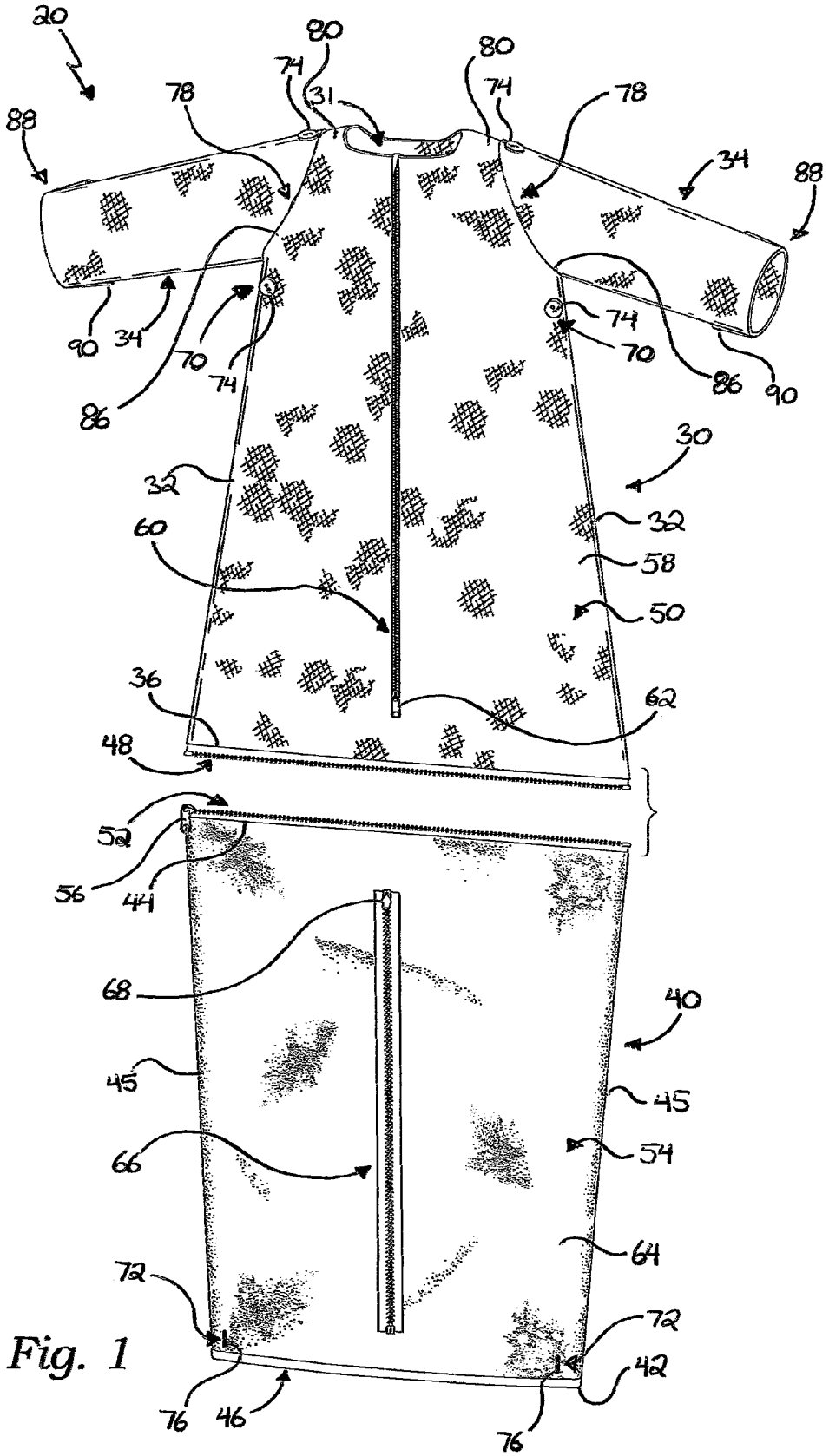
FIG. 1 is a perspective view of an exemplary embodiment of the inventive subject matter of a clothing apparatus to be worn by a baby with the cover being unsecured to the garment.

As shown in FIG. 1, there is shown a perspective view of an exemplary embodiment of the inventive subject matter of a clothing apparatus 20 to be worn by a baby comprising generally of a garment 30 and a cover 40, secured removably together by a first securing means 48 and a second securing means 52. The garment 30 having both an outer surface 50 and a garment front 58.

Figure 2:
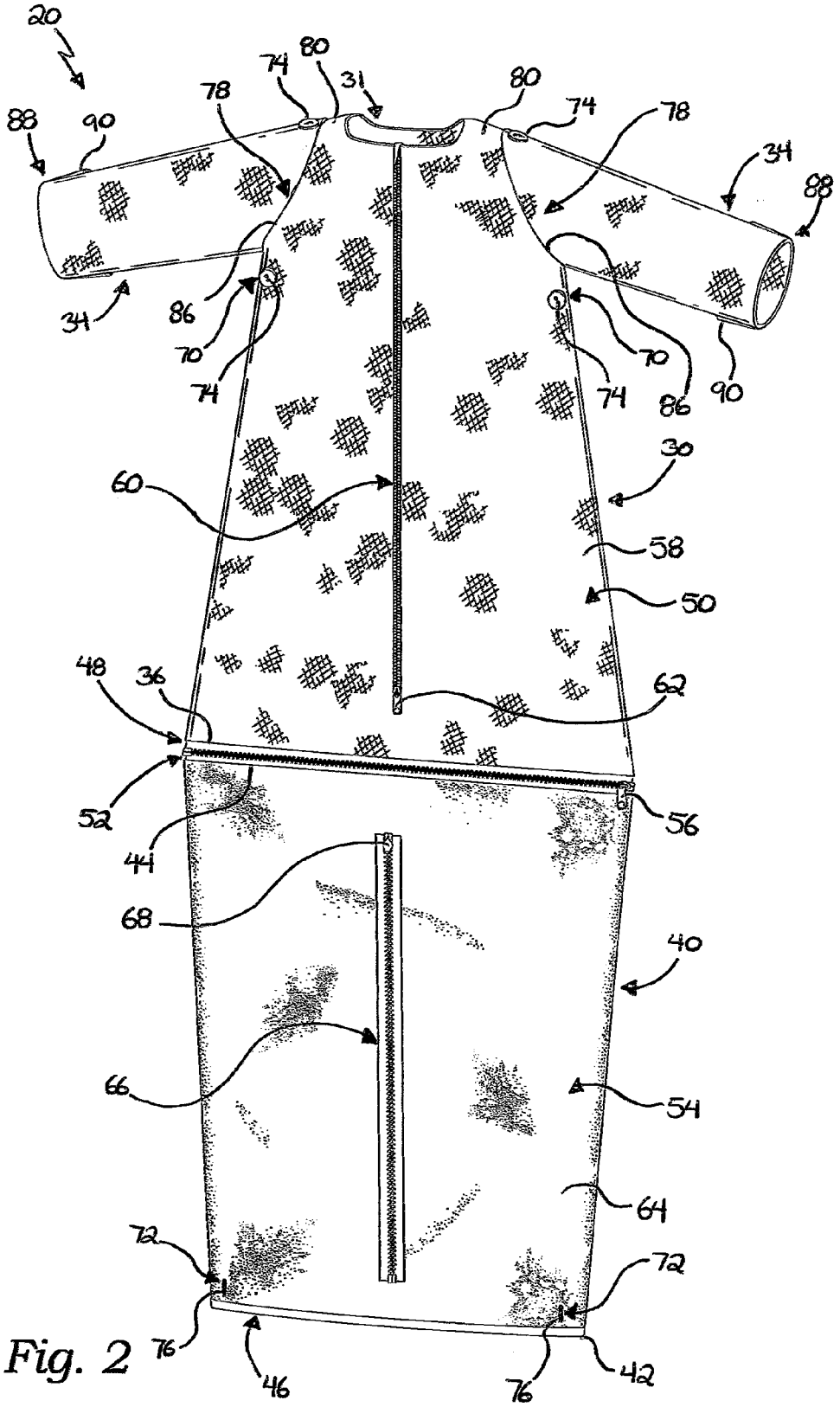
FIG. 2 is a perspective view of an exemplary embodiment of the inventive subject matter of a clothing apparatus to be worn by a baby with the cover being secured to the garment.

In a preferred exemplary embodiment, the clothing apparatus 20 for a baby may comprise of a neck aperture 31, garment side edges 32, arm apertures 33, a pair of opposing arm sleeves 34, and a garment 30 containing a closed bottom edge 36. The garment 30 also containing a garment access means 60 that in one preferred embodiment comprises of a zipper 62. The garment access means 60 allows the user easy access to the baby to perform such things as diaper changes. In one preferred embodiment, the garment 30 of the clothing apparatus 20 for a baby comprises of cuff portions 90 that is coupled to the ends of both sleeves 34 and that can be pulled over a baby's hand when desired. In a preferred exemplary embodiment, the cover 40 of the clothing apparatus 20 for a baby may be in the form of a blanket. One can appreciate that the blanket may come in a variety of materials, sizes, designs and colors providing the user the ability to swap and/alternate between different types of blanket based upon the needs of the user. For example, in winter months, the user may opt to use a thicker blanket to keep the baby warm whereas in summer months, the user may opt to use a lighter material blanket at night. In one preferred embodiment the cover 40 in the form of a blanket contains a cover front 64, a cover back 65, a cover access means 66, including a cover access zipper 68 which works in unison with the garment access means 60 to allow the user the ability to access the baby to perform such things as diaper changes. FIG. 2 shows the preferred exemplary embodiment of FIG. 1 whereby the garment 30 of the clothing apparatus 20 for a baby is shown coupled to the cover 40 by securing the bottom edge of the garment 36 to the cover bottom edge 44 via a first securing portion 48 and a second securing portion 52. In one preferred embodiment, the first securing means 48 and second securing means 52 are coupled together by a zipper 56.

Figure 3:
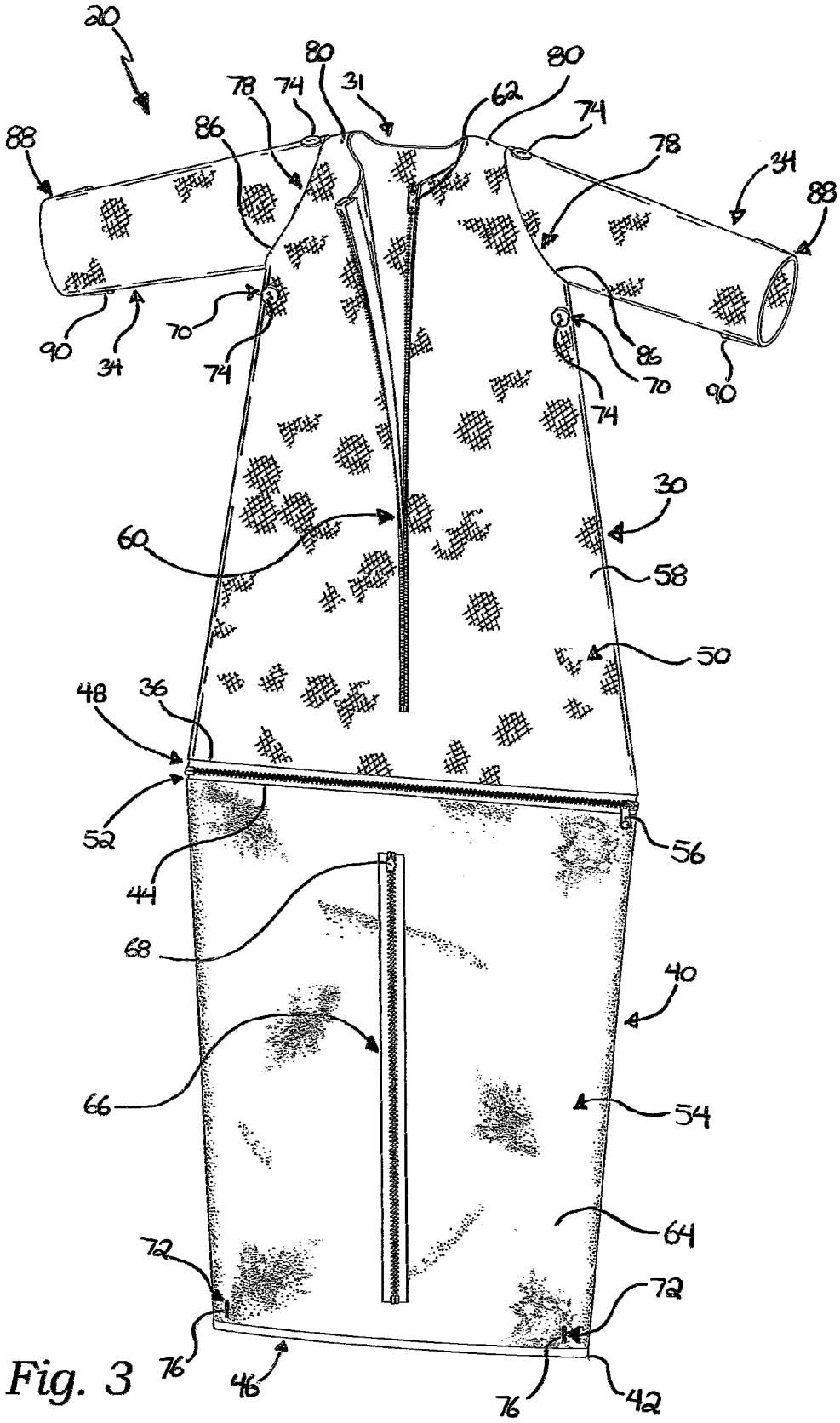
FIG. 3 is a perspective view of an exemplary embodiment of the inventive subject matter of a clothing apparatus to be worn by a baby depicting the garment in an opened state.
Figure 4:
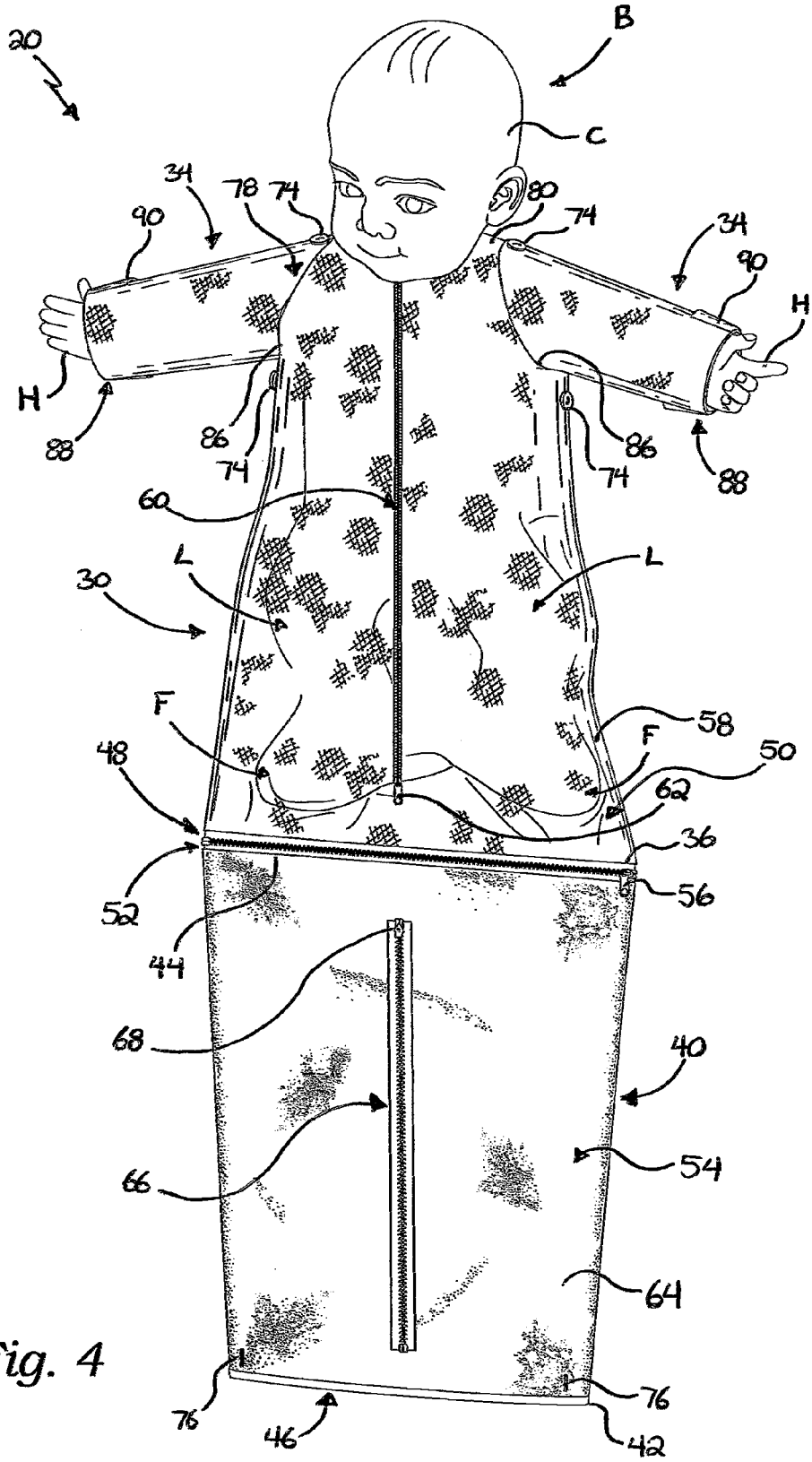
FIG. 4 is a perspective view of an exemplary embodiment of the inventive subject matter of a clothing apparatus to be worn by a baby depicting the garment in a closed state containing a baby inside the garment.

Turning to FIG. 3, the preferred exemplary embodiment of the clothing apparatus 20 for a baby is shown where the garment 30 is in an open position whereas the garment access means 60 is un-secured allowing the garment 30 the ability to be opened and prepared to accept a baby inside the garment 30. FIG. 4 shows the preferred exemplary embodiment of the clothing apparatus 20 with a baby securely positioned inside the garment 30 with the baby's legs L and feet F are securely contained inside the garment 30. The head C of the baby B would be positioned through the neck aperture 31 (shown in FIG. 1) leaving the baby's face and mouth areas open and free from interference. In this preferred exemplary embodiment, the arm sleeves 34 are in its normal position which covers the baby's arms but not the baby's hands H.

Figure 5:
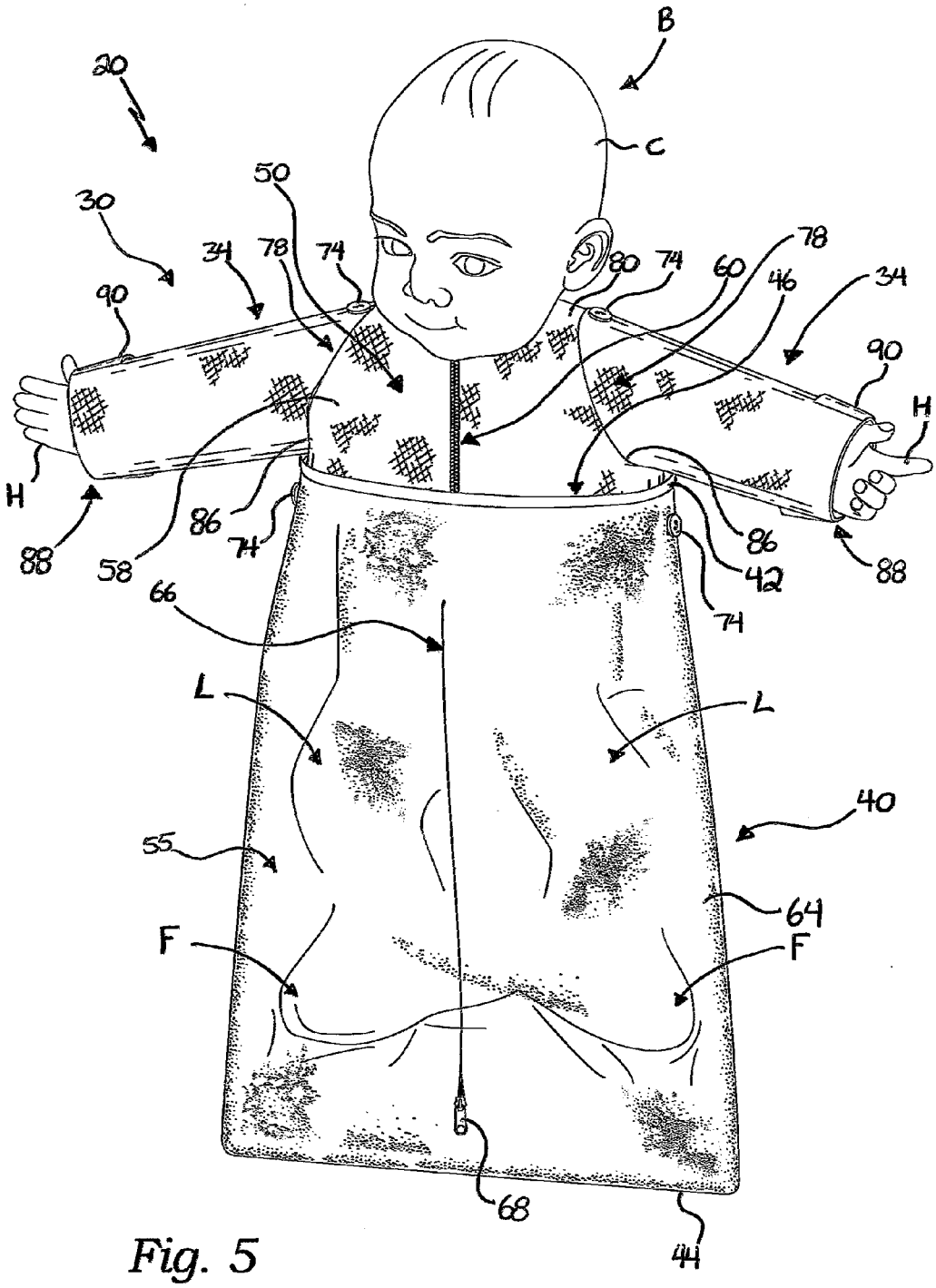
FIG. 5 is a perspective view of an exemplary embodiment of the inventive subject matter of a clothing apparatus to be worn by a baby depicting the cover being positioned over the baby's torso region.
Figure 6:
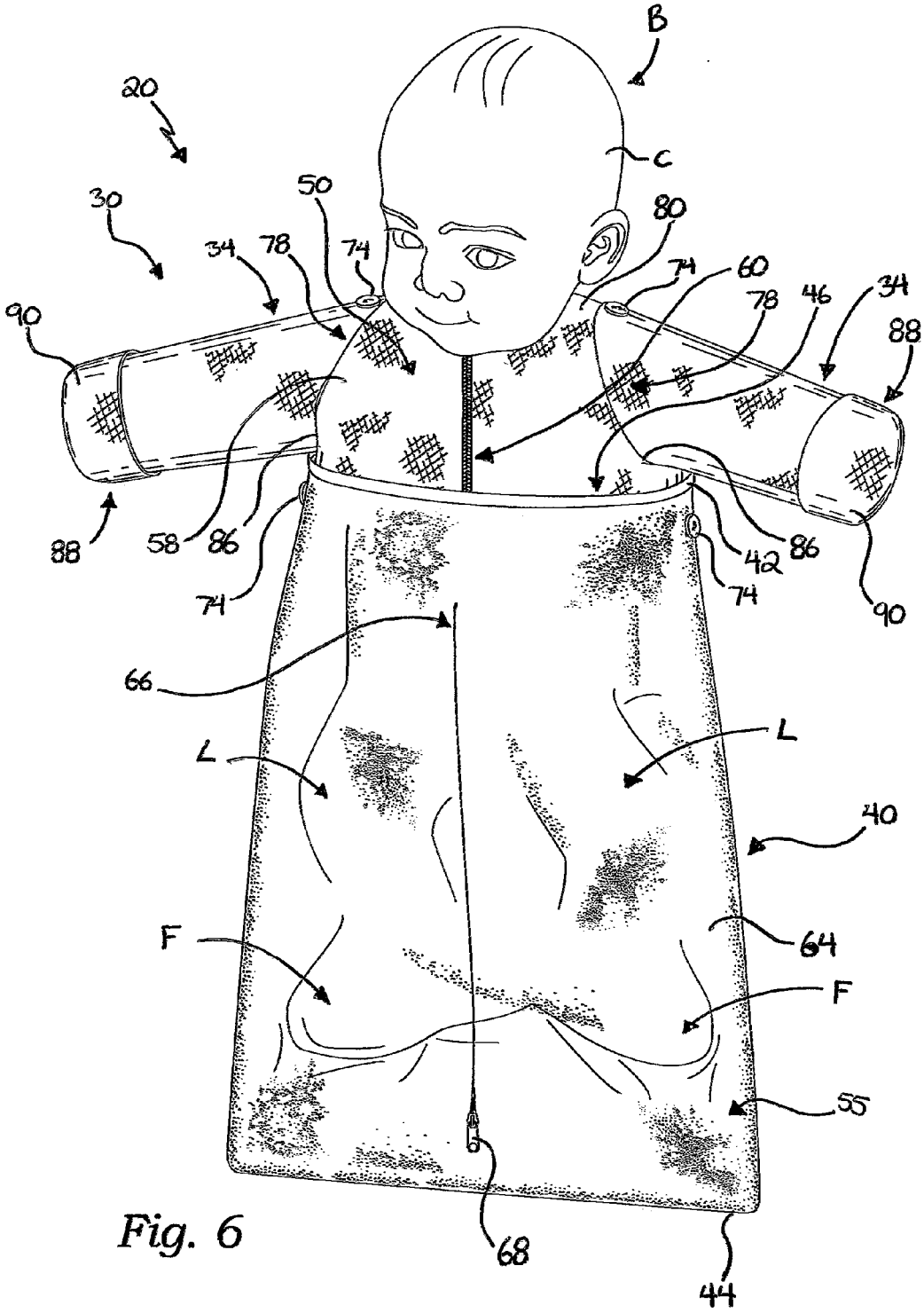
FIG. 6 is a perspective view of an exemplary embodiment of the inventive subject matter of a clothing apparatus to be worn by a baby depicting the cover being positioned over the baby's torso region and having adjustable cuffs which cover the baby's hands.

Referring now to FIG. 5, an exemplary embodiment of the clothing apparatus 20 for a baby is shown in a configuration having the cover 40 positioned over the garment 30 and over the baby's torso area. In practical use, the user would simply secure the garment 30 and cover 40 by the first securing portion 48 and second securing portion 52 by a zipper 56 and then would simply slide or pull the cover opening 46 of the cover 40 up and over the garment 30 area which covers the baby's torso or other desired area on the baby. In the process, the cover interior 54 is flipped in a way where the cover interior 54 becomes the inside portion of the cover 40 resulting in the outside surface 55 comprising of an outside cover front 64. In one preferred embodiment, the cover top edge 42 can be secured to the garment 30 by a button 74 to the first maintaining portion 70 which corresponds to the plurality of button apertures 76 to the second maintaining portion 72 provided on the cover 40 which prevents the cover 40 from unwanted movement. As shown in FIG. 6, the distal ends 88 of the arm sleeves 34 include a plurality of cuff portions 90 that can be used to cover the hands of a baby when desired to provide additional warmth and/or prevent the baby from potentially injuring himself/herself as a result of the baby's unrestrained hands and fingers.

Figure 7:
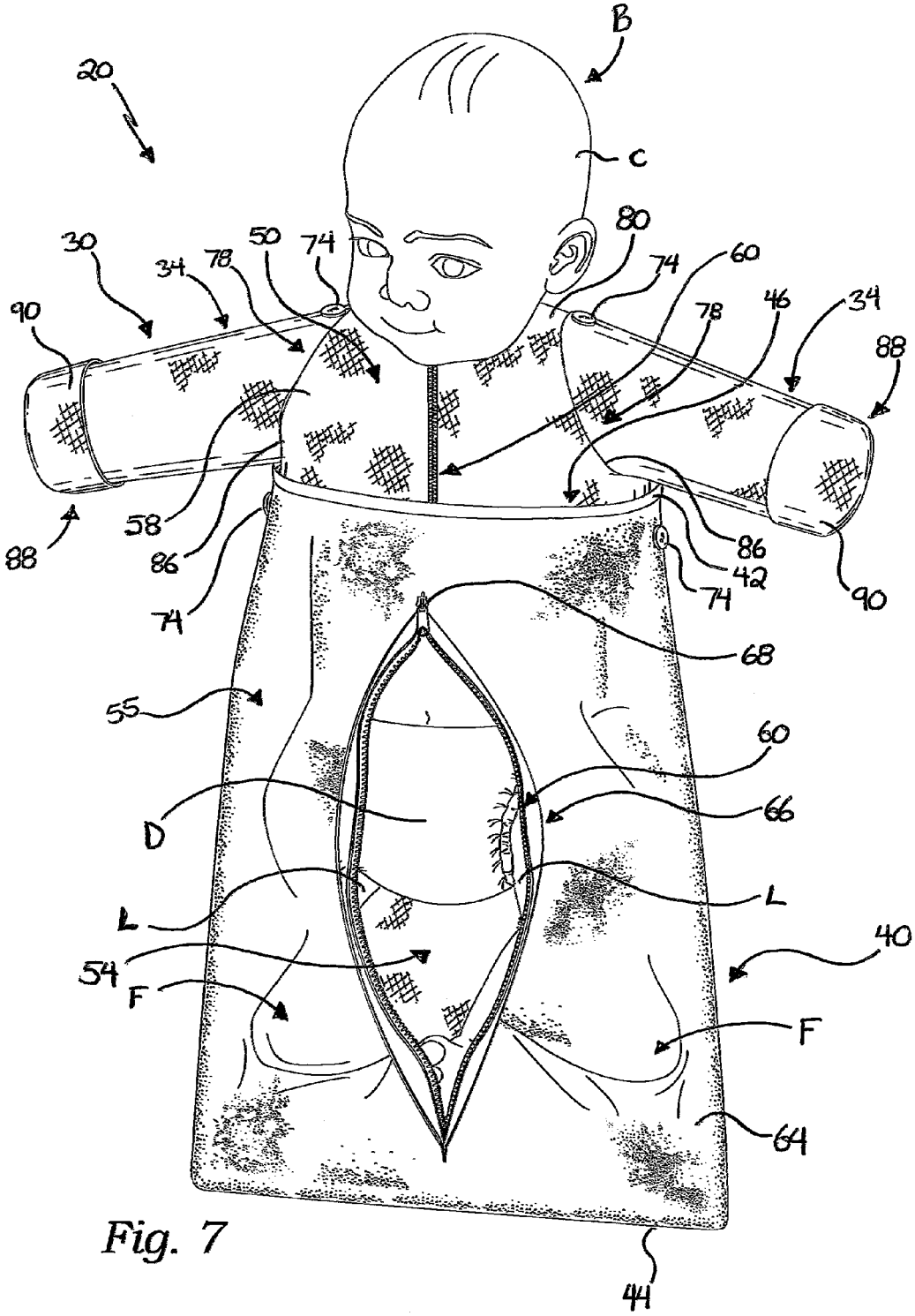
FIG. 7 is a perspective view of an exemplary embodiment of the inventive subject matter of a clothing apparatus to be worn by a baby depicting both the garment and cover being opened to allow access to the diaper of the baby.

Turning to FIG. 7, an exemplary embodiment of the clothing apparatus 20 for a baby is shown having both the garment access means 60 and the cover access means 66 being in an open position allowing the user convenient access to the baby's diaper D and the inner surface of the garment 54. To accommodate changes in temperature during a sleep session, the user has the option to allow the garment 30 and/or cover 40 to remain open to allow improved airflow inside the garment 30 and cover 40 which would practically cool down the baby.

Figure 8:
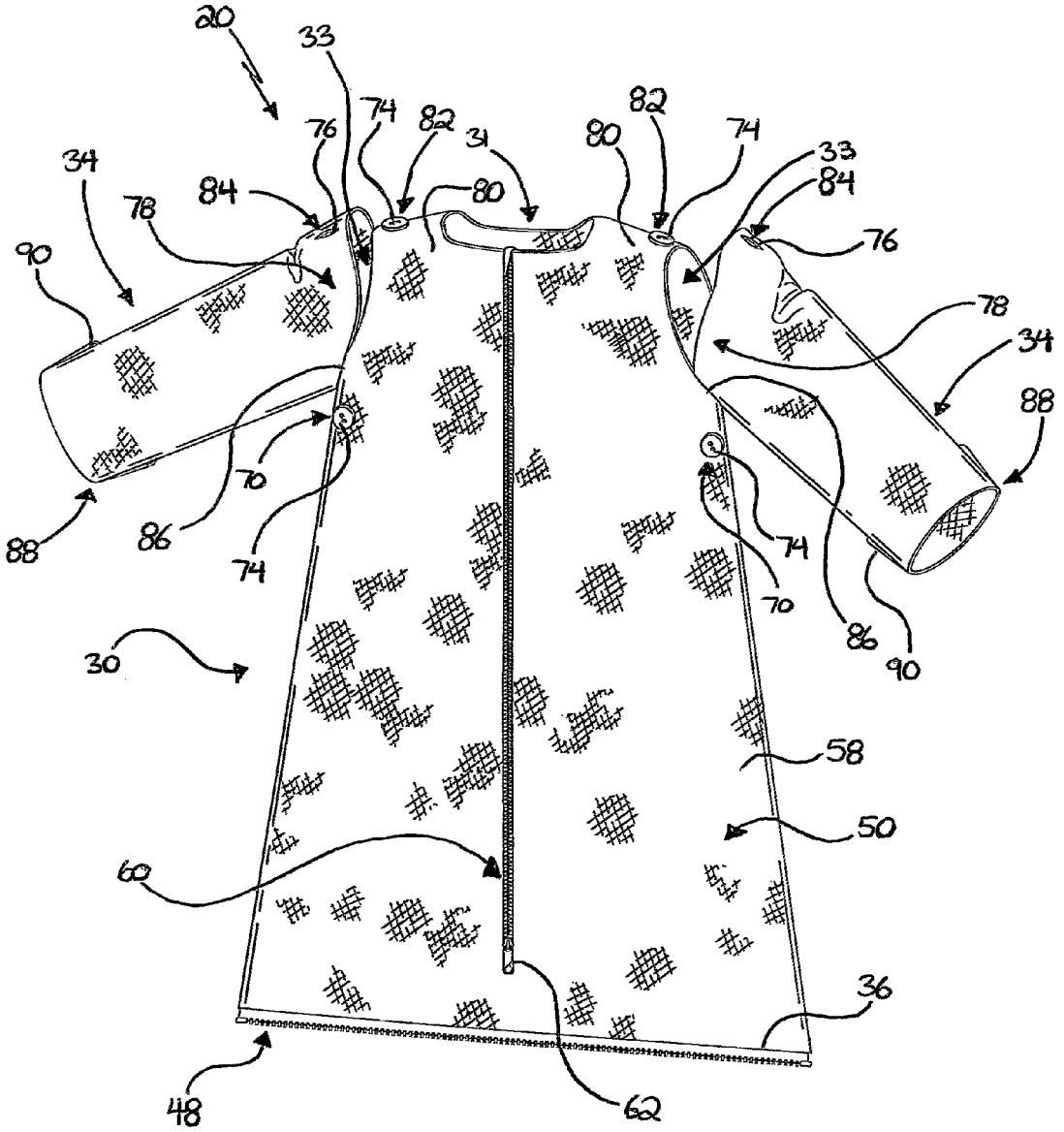
FIG. 8 is a perspective view of an exemplary embodiment of the inventive subject matter of a clothing apparatus showing the sleeves of the garment being detached to allow for adjustability and to accommodate for temperature changes.
Figure 9:
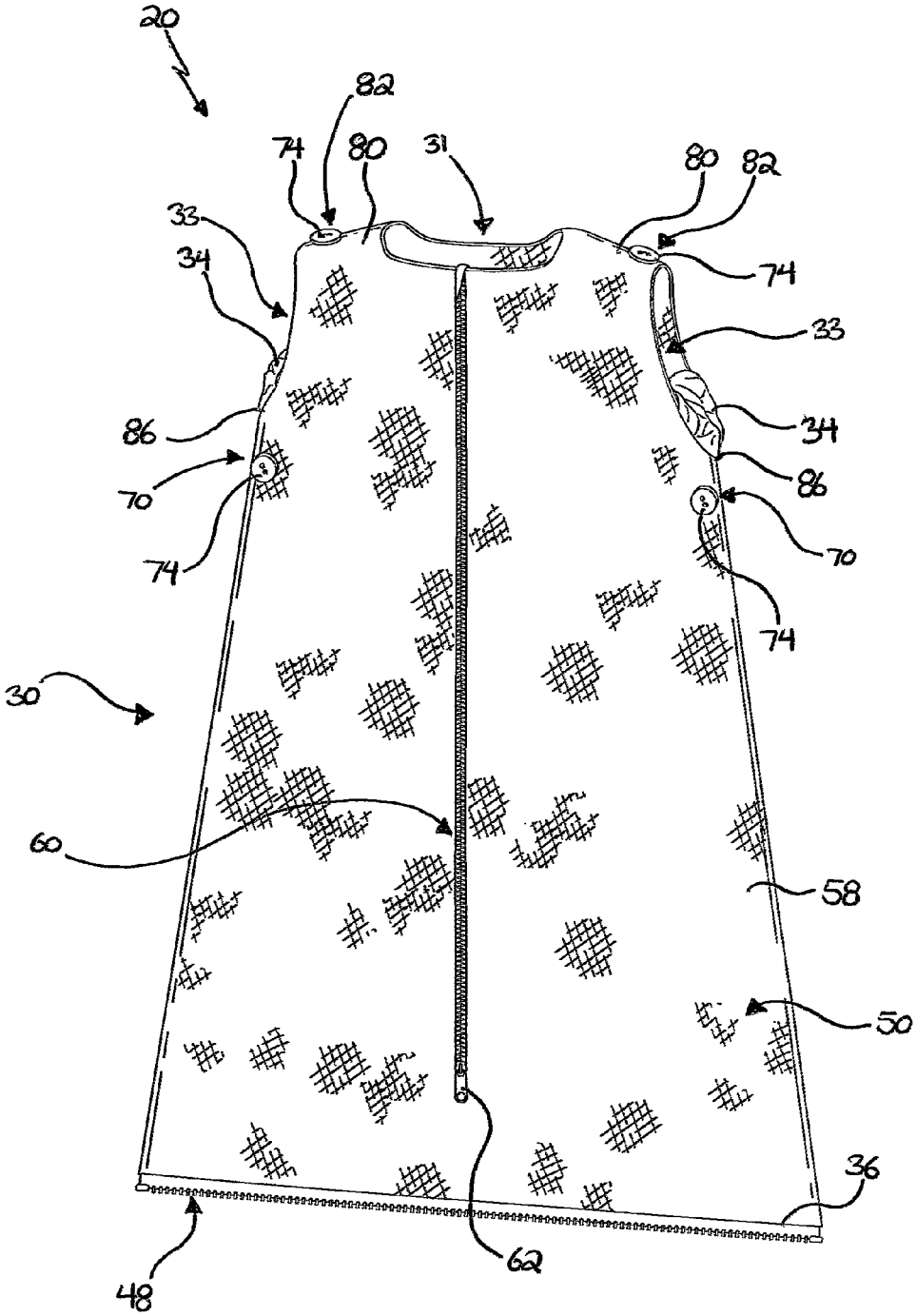
FIG. 9 is a perspective view of an exemplary embodiment of the inventive subject matter of a clothing apparatus to be worn by a baby depicting sleeves of the garment being positioned inside the garment whereby allowing a sleeveless configuration.
Figure 10:
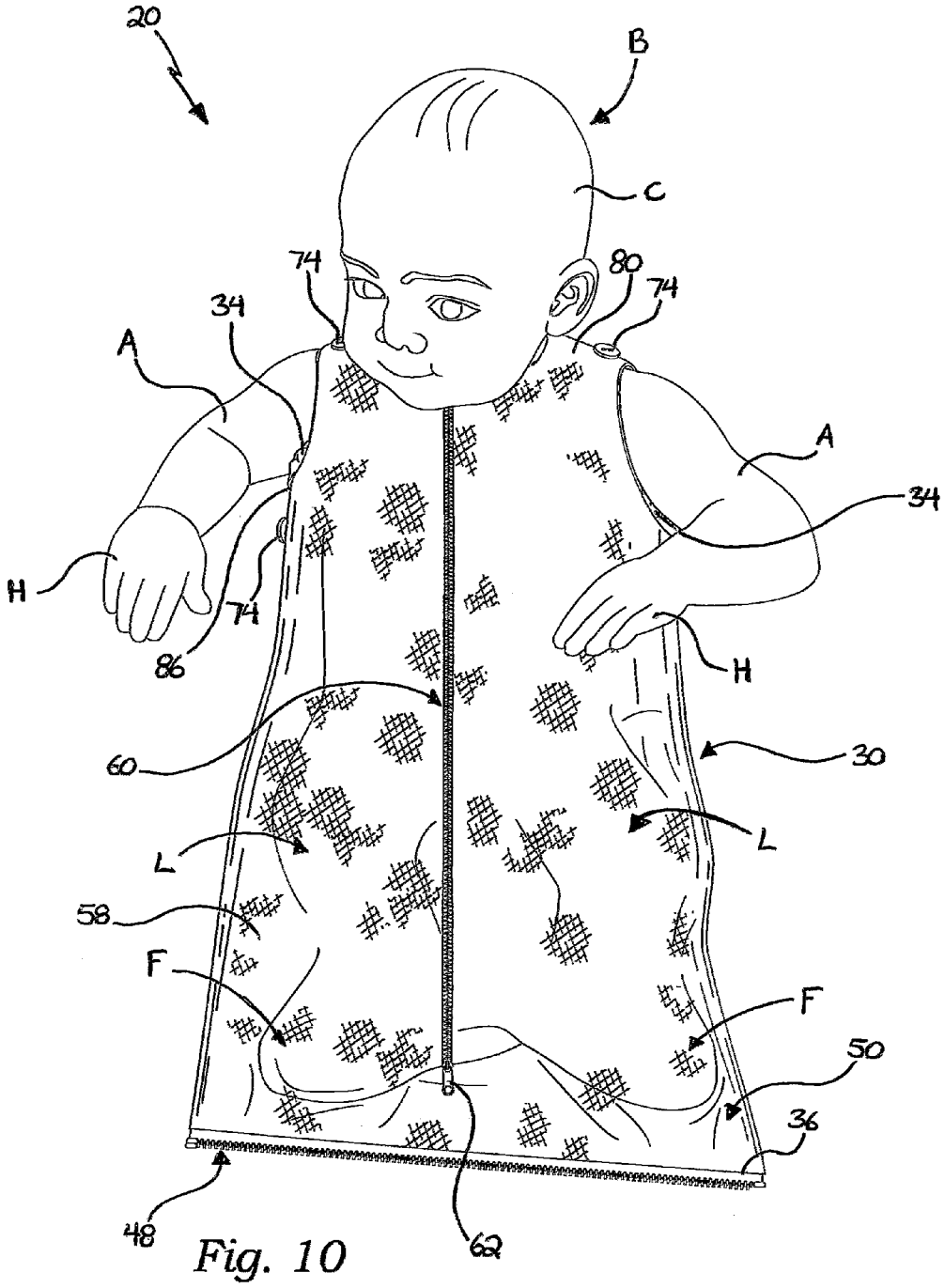
FIG. 10 is a perspective view of an exemplary embodiment of the inventive subject matter of a clothing apparatus to be worn by a baby depicting a baby inside of the garment without a cover in a sleeveless configuration.

FIG. 8 illustrates an exemplary embodiment of the garment 30 of clothing apparatus 20 for a baby having the arm sleeves 34 comprising of a proximal end 78 and a distal end 88 in an open position at the shoulder portion 80 by un-securing and/or removing the first sleeve engagement means 82 from the second sleeve engagement means 84. In one preferred embodiment, the first sleeve engagement means 82 are buttons and the second sleeve engagement means 84 are button holes. In one exemplary use, a user may desire to provide more air circulation for the baby inside the clothing apparatus 20 and choose to unsecure the shoulder portions to provide more venting of air. In addition, the shoulder portions 80 when unsecured may become less rigid thus being more flexible for the baby's shoulders whereby providing additional comfortability for the baby. With the arm sleeves 34 now unsecured at the shoulder portions 80 of the garment 30, another exemplary embodiment of the clothing apparatus 20 for a baby allows the ability for the user to tuck the sleeves 34 inside the garment 30 whereby converting the clothing apparatus 20 into a sleeveless version which is shown in FIGS. 9 and 10 thereby leaving the baby's arms A exposed. The sleeves remain attached to the garment 30 by the plurality of lower edges of the arm sleeves 86 which allows the arm sleeves 34 to be tucked inside the garment 30 but yet remain securely attached to the garment 30. FIGS. 9 and 10 also depict the baby inside the garment 30 of the clothing apparatus 20 without the cover 40 in a sleeveless version. This provides another exemplary embodiment of the clothing apparatus 20 being possibly used in warmer environment thereby negating the need of incorporating the cover 40 and the arm sleeves 34 which allows the baby to still be kept inside the garment 30 of the clothing apparatus 20 but still remain comfortable based upon the temperature conditions. Should the temperature conditions change, the user would easily just convert the clothing apparatus 20 into a version as shown in FIG. 6 or any other above stated configurations.

Figure 11:
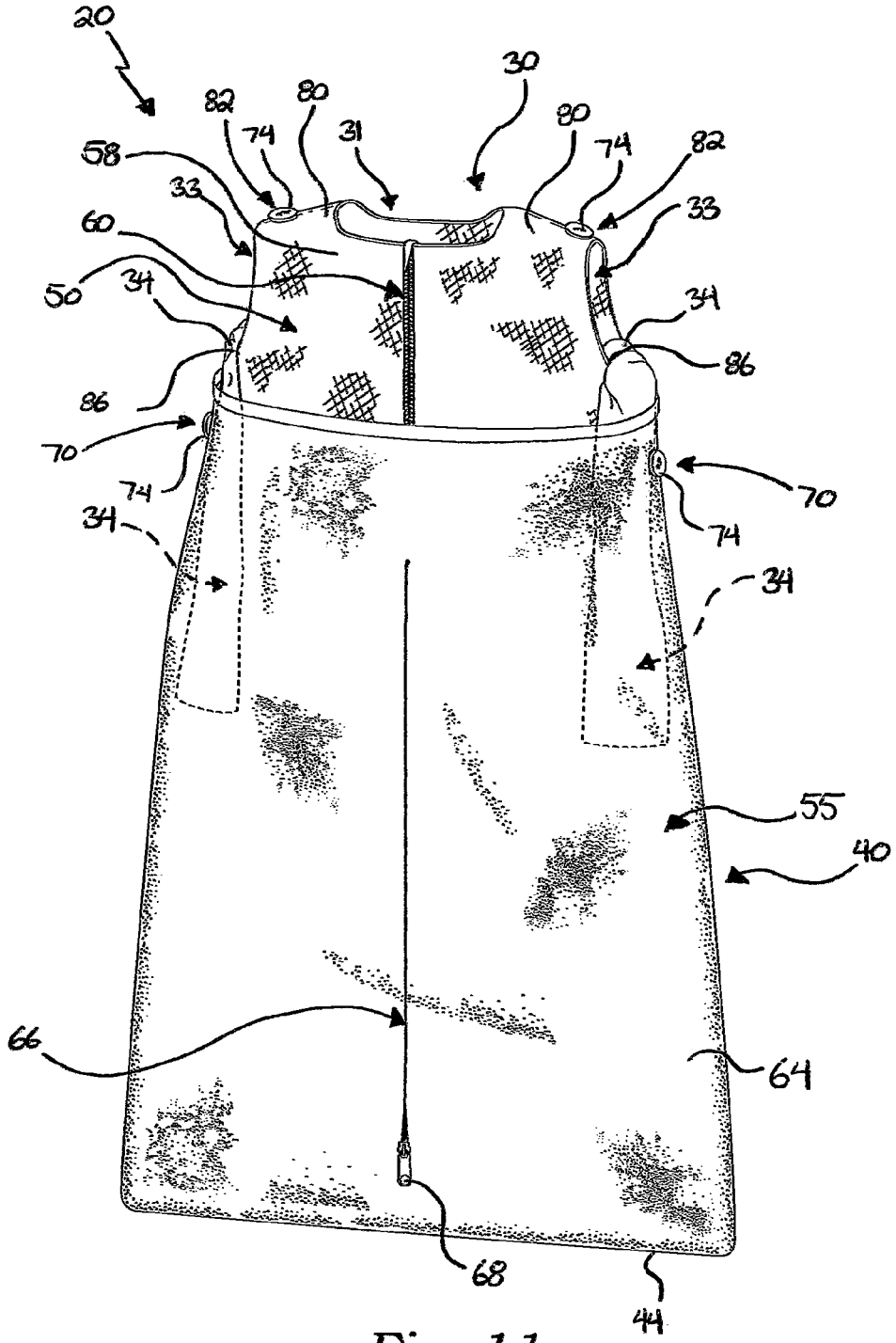
FIG. 11 is a perspective view of an exemplary alternative embodiment of the inventive subject matter of a clothing apparatus to be worn by a baby depicting sleeves of the garment being positioned on the side of the garment tucked in by the cover whereby allowing a sleeveless configuration.

Turning to FIG. 11, an alternative embodiment of the baby clothing apparatus 20 wherein the arm sleeves 34 may be detached from the shoulder portion 80 allowing for at least one arm aperture 33 being on the outside side of the garment 30 and tucked between the garment 30 and the cover 40. In this alternative embodiment, at least one Baby arms A may protrude through at least one arm aperture 33 in a sleeveless configuration allowing at least one lower edge 86 of the arm sleeves 34 to securely allow at least one arm sleeve 34 to remain attached to the garment 30 along its side and being additional secured to the garment 30 side by the cover 40.

Figure 12:
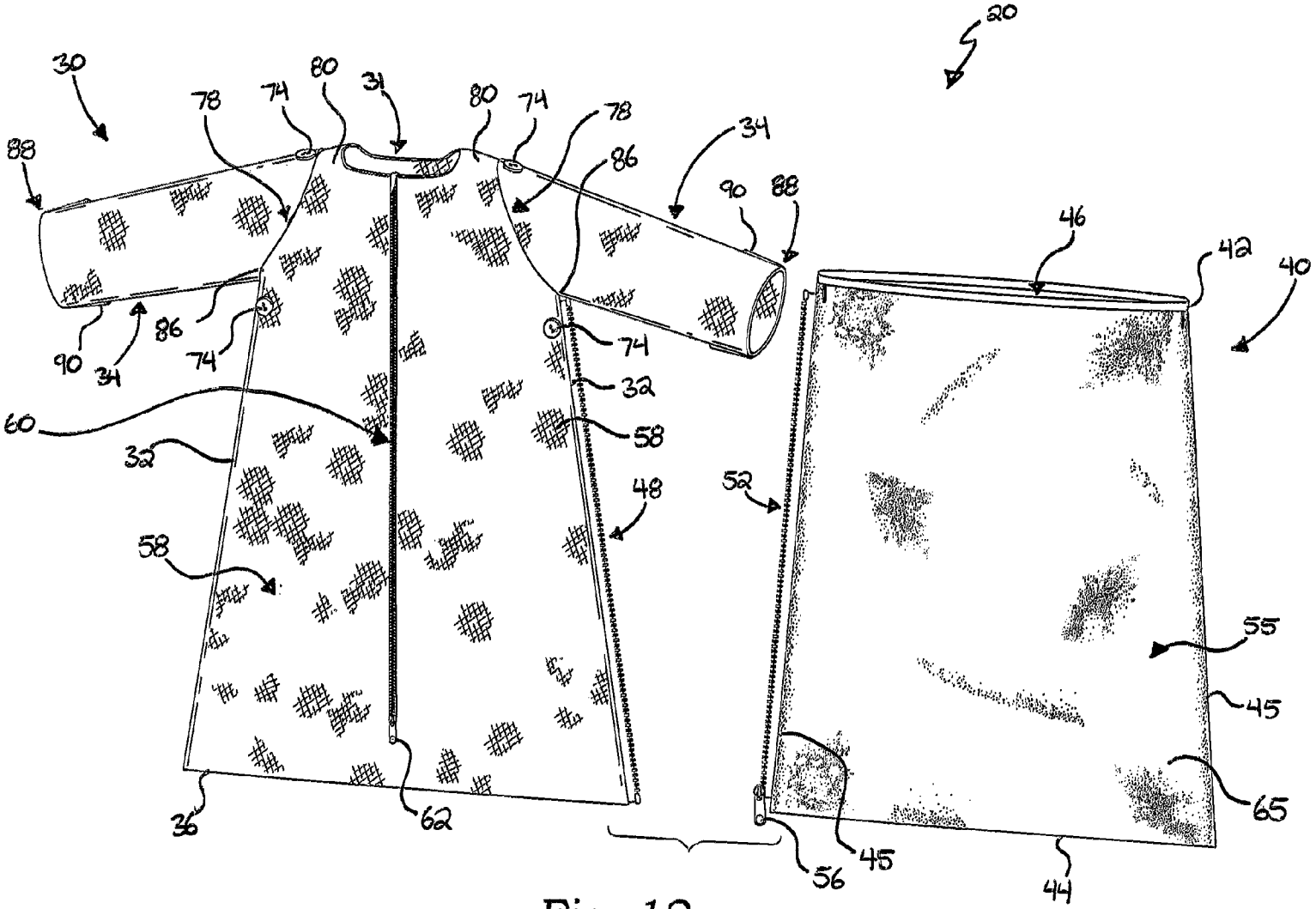
FIG. 12 is a perspective view of an exemplary embodiment of the inventive subject matter of a clothing apparatus depicting an alternative embodiment of the first and second securing portion.

FIG. 12 depicts an alternative embodiment of the baby clothing apparatus 20 which may comprise of the first securing portion 48 on at least one side of the garment 30 extending from one of the arm apertures 33 to the bottom edge of the garment 36, and which allows the user to attach the cover 40 with a second securing portion 52 via a zipper 56 extending from the cover top edge 42 to the cover bottom edge 44. In one preferred embodiment, the user may wrap the cover 40 around the torso of the baby B inside the garment 30 to provide swaddling support if desired.

While aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

Thus, specific embodiments and applications of a baby clothing apparatus have been disclosed. It should be apparent, however, to those skilled in the art that many more modifications besides those already described are possible without departing from the inventive concepts herein. The inventive subject matter, therefore, is not being restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps may be present, or utilized, or combined with other elements, components, or steps that are not expressly referenced. Insubstantial changes from the claimed subject matter as viewed by a person with ordinary skill in the art, now known or later devised, are expressly contemplated as being equivalent within the scope of the claims. Therefore, obvious substitutions now or later known to one with ordinary skill in the art are defined within the scope of the defined elements. The claims are thus to be understood to include what is specifically illustrated and described above, what is conceptually equivalent, what can be obviously substituted and also what essentially incorporates the essential idea of the invention. In addition, where the specification and claims refer to at least one of something selected from a group consisting of A, B, C . . . and N, the text should be interpreted as requiring only one element from the group, not A plus N, or B plus N etc.

The invention claimed is:

1. A clothing apparatus to be worn by a baby, the apparatus comprising:

a garment sized and configured for being worn by the baby, the garment providing a neck aperture, a pair of laterally opposed garment side edges, each of the garment side edges defining an arm aperture proximal the neck aperture, and a closed garment bottom edge for enclosing the baby's legs and feet within the garment;

a cover sized and configured for selectively covering at least a portion of the garment while worn by the baby, the cover providing a cover top edge, an opposing cover bottom edge, and a pair of laterally opposed cover side edges; and a means for selectively securing the cover to the garment comprising a first securing portion integral with the garment extending from one of the arm apertures to the closed garment bottom edge, and configured for selective engagement with a corresponding second securing portion integral with the cover extending from the cover top edge and the opposing cover bottom edge;

whereby, with the garment worn by the baby and the cover selectively secured to the garment, the cover may be selectively positioned for covering at least a portion of the garment and baby.

2. The clothing apparatus of claim 1, wherein the cover is configured as a sack for selectively receiving and enclosing therewithin at least a portion of the garment while worn by the baby, the cover bottom edge being closed and the cover top edge defining a cover opening sized for receiving at least a portion of the garment and baby therethrough.

3. The clothing apparatus of claim 1, wherein a free one of the cover side edges may be pulled toward the garment such that the cover wraps laterally around at least a portion of the garment and baby.

4. The clothing apparatus of claim 1, wherein the means for selectively securing the cover to the garment is selected from the group consisting of a hook and loop type fastener, buttons and button holes, zippers, snaps, laces and equivalent fasteners.

5. The clothing apparatus of claim 2, wherein a front of the garment provides a garment access means positioned and configured for providing selective access into the garment.

6. The clothing apparatus of claim 5, wherein a front of the cover provides a cover access means positioned and configured for providing selective access into the cover.

7. The clothing apparatus of claim 6, wherein the cover access means is positioned such that, when at least a portion of the garment is positioned within the cover, the cover access means is substantially adjacent to the garment access means.

8. The clothing apparatus of claim 1, further comprising a means for selectively maintaining the position of the cover over top of the garment.

9. The clothing apparatus of claim 8, wherein the means for selectively maintaining the position of the cover comprises a first maintaining portion integral with the outer surface of the garment and configured for selective engagement with a corresponding second maintaining portion integral with the cover.

10. The clothing apparatus of claim 9, wherein the means for selectively maintaining the position of the cover is selected from the group consisting of a hook and loop type fastener, buttons and button holes, zippers, snaps, laces and equivalent fasteners.

11. The clothing apparatus of claim 1, further comprising arm sleeves attached to the arm apertures.

12. The clothing apparatus of claim 11, wherein a proximal end of each of the arm sleeves is selectively engageable with a corresponding shoulder portion of the garment.

13. The clothing apparatus of claim 12, wherein each shoulder portion provides a first sleeve engagement means configured for selective engagement with a corresponding second sleeve engagement means integral with the respective one of the arm sleeves.

14. The clothing apparatus of claim 13, wherein the first and second sleeve engagement means is selected from the group consisting of a hook and loop type fastener, buttons and button holes, zippers, snaps, laces and equivalent fasteners.

15. The clothing apparatus of claim 12, wherein a portion of the proximal end of each of the arm sleeves is integral with the corresponding arm aperture, allowing the arm sleeves to be partially disengaged from the shoulder portions, passed through the corresponding arm aperture, and tucked inside the garment while worn by the baby.

16. The clothing apparatus of claim 15, wherein a lower edge of the proximal end of each of the arm sleeves is integral with the corresponding arm aperture.

17. The clothing apparatus of claim 1, wherein a distal end of each of the arm sleeves provides a cuff portion configured for being selectively pulled over the corresponding hand of the baby, enclosing the baby's hand therewithin.

18. A clothing apparatus to be worn by a baby, the apparatus comprising:

a garment sized and configured for being worn by the baby, the garment providing a neck aperture, a pair of laterally opposed garment side edges, each of the garment side edges defining an arm aperture proximal the neck aperture, and a closed garment bottom edge for enclosing the baby's legs and feet within the garment;

a cover sized and configured for selectively receiving and enclosing therewithin at least a portion of the garment while worn by the baby, the cover providing a cover top edge and an opposing closed cover bottom edge, the cover top edge defining a cover opening sized for receiving at least a portion of the garment and baby therethrough; and a means for selectively securing the cover to the garment comprising a first securing portion integral with an outer surface of the garment extending from one of the arm apertures to the closed garment bottom edge, and configured for selective engagement with a corresponding second securing portion integral with an inner surface of the cover extending from the cover top edge and the opposing closed cover bottom edge;

whereby, with the garment worn by the baby and the cover selectively secured to the garment, the cover top edge may be pulled toward the garment such that the cover and at least a portion of the garment passes through the cover opening, thereby enclosing at least a portion of the garment and baby within the cover.

19. A clothing apparatus to be worn by a baby, the apparatus comprising:

a garment sized and configured for being worn by the baby, the garment providing a neck aperture, a pair of laterally opposed arm sleeves, and a closed garment bottom edge for enclosing the baby's legs and feet within the garment;

a proximal end of each of the arm sleeves being partially selectively engageable with a corresponding shoulder portion of the garment, allowing the arm sleeves to be partially disengaged from the shoulder portions and tucked inside the garment while worn by the baby;

a cover sized and configured for selectively covering at least a portion of the garment while worn by the baby, the cover providing a cover top edge and an opposing cover bottom edge; and a means for selectively securing the cover to the garment comprising a first securing portion integral with the garment extending from the proximal end of one of the arm sleeves to the closed garment bottom edge, and configured for selective engagement with a corresponding second securing portion integral with the cover extending from the cover top edge and the opposing cover bottom edge, the means for selectively securing the cover to the garment operating to allow the cover to be selectively positioned for covering at least a portion of the garment and baby;

whereby, with the arm sleeves being selectively partially disengageable and the cover being selectively engageable and positionable overtop of the garment, the apparatus provides a variety of selectively interchangeable warmth options, depending on the temperature of the baby's surrounding environment during use.

* * * * *